US006439074B1

(12) United States Patent
Stencel

(10) Patent No.: US 6,439,074 B1
(45) Date of Patent: Aug. 27, 2002

(54) PLASTIC STEERING-COLUMN GEARSHIFT LEVER

(75) Inventor: Jacob M. Stencel, Warren, MI (US)

(73) Assignee: Dura Global Technologies, Rochester Hills, MI (US)

( * ) Notice: Subject to any disclaimer, the term of this patent is extended or adjusted under 35 U.S.C. 154(b) by 0 days.

(21) Appl. No.: 09/608,877

(22) Filed: Jun. 30, 2000

(51) Int. Cl.[7] ..... G05G 1/06
(52) U.S. Cl. ..... 74/473.31; 74/523
(58) Field of Search ..... 74/473.1, 473.3, 74/473.31, 473.32, 523, 543–551, 558

(56) References Cited

U.S. PATENT DOCUMENTS

| | | | | | |
|---|---|---|---|---|---|
| 2,247,164 | A | * | 6/1941 | Butzbach | 74/473.31 |
| 3,750,492 | A | * | 8/1973 | Holmes, Jr. | 74/473.31 |
| 4,342,369 | A | * | 8/1982 | Ransom | 74/558 |
| 4,598,606 | A | | 7/1986 | Foggini | |
| 4,805,476 | A | * | 2/1989 | Beauch et al. | 74/473.31 |
| 5,179,870 | A | * | 1/1993 | Behrens et al. | 74/473.3 |
| 5,372,051 | A | * | 12/1994 | Kanematsu et al. | 74/523 |
| 5,557,981 | A | | 9/1996 | Neal et al. | |
| 5,742,014 | A | * | 4/1998 | Schwartz et al. | 200/61.27 |
| 6,006,887 | A | * | 12/1999 | Tazai | 74/473.31 |

* cited by examiner

*Primary Examiner*—Chong H. Kim
(74) *Attorney, Agent, or Firm*—Casimir R. Kiczek

(57) ABSTRACT

A steering-column gearshift lever includes a molded tube comprised of a polymeric material and forming a conduit from an operative end to an attachment end, a metal insert secured to the attachment end which is sized and shaped for mechanical cooperation with components auxiliary to the lever, and a molded covering of polymeric material which extends over at least a portion of an exterior surface of the tube and the insert. The plastic tube and the plastic covering are formed in separate injection molding operations. The lever further includes an electrical switch supported by the operative end of the tube and wires connected to the electrical switch which pass through the conduit of the tube from the operative end to the attachment end. The wires extend from the attachment end of the tube through a passage in the insert where they can be suitably connected to auxiliary components at the steering column when the gearshift lever is attached to the steering column. The tube preferably has complex compound bends and the conduit follows the complex compound bends so that a handle portion at the operative end of the tube is suitably positioned relative to the steering column. The tube preferably includes a main portion and a cover portion adapted to cooperate with the main portion to form the conduit. The main and cover portions are adapted for injection molding and cooperate when placed together to seal the conduit during subsequent molding of the covering. Preferably, the covering secures the tube main and cover portions together and the tube and insert together without the need for additional fastening means.

14 Claims, 6 Drawing Sheets

PLASTIC STEERING-COLUMN GEARSHIFT LEVER

FIELD OF THE INVENTION

The present invention generally relates to an improved gearshift lever for a steering column and, more particularly, to such a gearshift lever having an electrical switch at an operative end of the gearshift lever.

BACKGROUND OF THE INVENTION

A gearshift lever is typically provided in a motor vehicle, such as an automobile, to control a gear box or transmission connecting an engine with driven wheels. The gearshift lever can extend from the vehicle floor or a steering column of the vehicle. When extending from the steering column, the gearshift lever typically has a shape with compound bends to optimally position the ends of the gearshift lever. Often, an electrical switch, such as a push-button type switch, is provided at the operative or free end of the gearshift lever so that the driver can easily activate or deactivate a particular device. When such a switch is provided, wires are routed along the length of the gearshift lever from the attachment end of the gearshift lever at the steering column to the switch located at a handle or knob on the operative end.

One method of forming such a "switched" column gearshift lever is to drill a central passage along the length of a steel rod. The rod is deburred to decrease the risk of damage to the wires due to burrs formed in the drilling operation. The rod is then bent to a desired shape. The rod then undergoes a washing operation to decrease the risk of contamination during subsequent molding operations. The rod is then placed in a mold and a polymeric covering is formed about the rod. A hand grip portion or knob forming a seat for the electrical switch is either integrally molded with the covering to the operative end or secured to the operative end before or after the molding operation. The switch is secured to the knob with wires extending through the central passage to the attachment end where they are connected to auxiliary components of the particular device which the switch controls so that the operator can control the device with the switch.

While such a method forms suitable switched steering-column gearshift levers, it has several disadvantages. For example, the drilling, deburring, bending, and washing operations are extremely labor intensive. Additionally, the metal rods can cause extensive damage to the molds when the bends are out of tolerance and therefore do not properly cooperate with the molds. Moreover, the metal rods can cause extensive contamination of the molds if they are not properly cleaned prior to insertion into the molds.

Accordingly, there is a need in the art for a steering-column gearshift lever which is produced with an increased number automatic operations, which causes decreased amounts of mold damage and contamination during molding operations, is relatively inexpensive to produce, is relatively lightweight, and is highly reliable to operate.

SUMMARY OF THE INVENTION

The present invention provides a steering-column gearshift lever for a motor vehicle which overcomes at least some of the above-noted problems of the related art. According to the present invention, a steering-column gearshift lever includes, in combination, a tube comprised of a polymeric material and forming a conduit from an operative end to an attachment end, an electrical switch supported by the operative end of the tube, and wires connected to the electrical switch and passing through the conduit from the operative end to the attachment end. In a preferred embodiment of the present invention, the tube has compound bends and the conduit and wires follow the compound bends. The present invention provides a steering-column gearshift lever which is formed by highly automatic and repeatable molding operations, eliminates mold damage due to improper bending of tubes by eliminating bending operations, and reduces metal contamination during molding operations by reducing the number of metal components.

According to another aspect of the present invention, a steering-column gearshift lever comprising, in combination, a tube comprised of a polymeric material and forming a pocket at an attachment end and a metal insert secured to the attachment end and extending into the pocket. The metal insert is sized and shaped for mechanical cooperation with components auxiliary to the lever. In a preferred embodiment the metal insert is secured to the tube with an interference fit therebetween.

According to another aspect of the present invention, a steering-column gearshift lever comprises, in combination, a tube of polymeric material and forms a conduit from an operative end to an attachment end. The tube includes a main portion and a cover portion adapted to cooperate with the main portion to form the conduit. A covering of polymeric material extends over at least a portion of an exterior surface of the main and cover portions of the tube. The tube and the covering are formed in separate molding operations. In a preferred embodiment, the main and cover portions are adapted for injection molding and cooperate when placed together to seal the conduit during subsequent molding of the covering and prevent covering material from bleeding into the conduit during molding of the covering. The present invention provides a steering-column gearshift lever permits the use of separate structural and covering materials which are formed by separate injection molding operations.

From the foregoing disclosure and the following more detailed description of various preferred embodiments it will be apparent to those skilled in the art that the present invention provides a significant advance in the technology and art of steering-column gearshift levers. Particularly significant in this regard is the potential the invention affords for providing a high quality, reliable, light weight, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
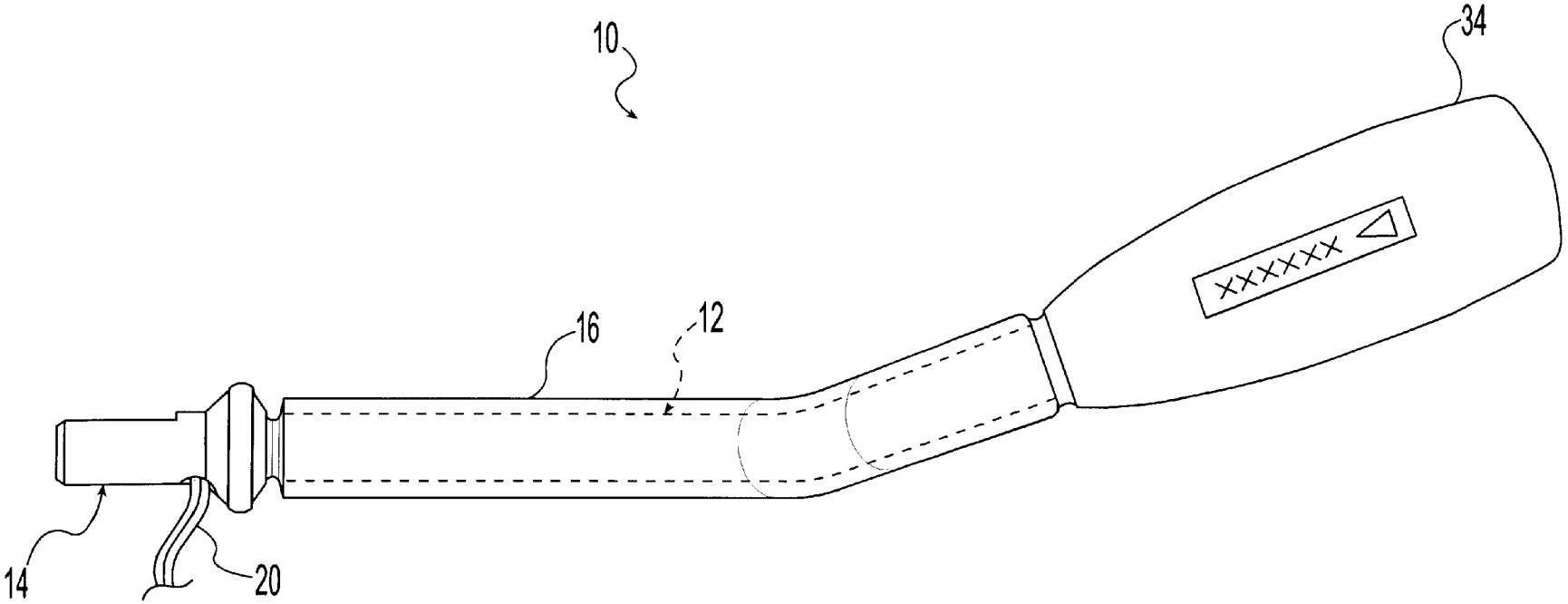
FIG. 1 is a top plan view of a steering-column gearshift lever according a preferred embodiment of the present invention.

It should be understood that the appended drawings are not necessarily to scale, presenting a somewhat simplified representation of various preferred features illustrative of the basic principles of the invention. The specific design features of steering-column gearshift lever as disclosed herein, including, for example, specific dimensions, orientations, and shapes of the tube and cover will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the column gearshift lever illustrated in the drawings. In general, up or upward refers to an upward direction out of the plane of the paper in FIGS. 1, 3, 5, and 9 and down or downward refers to a downward direction into the plane of the paper in FIGS. 1, 3, 5, and 9. Also in general, fore or forward refers to a direction toward the front of the motor vehicle, that is, in an upward direction in the plane of the paper in FIGS. 1, 3, 5 and 9 and aft or rearward refers to a direction toward the rear of the motor vehicle , that is, in a downward direction in the plane of the paper in FIGS. 1, 3, 5, and 9.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved steering-column gearshift lever disclosed herein. The following detailed discussion of various alternative and preferred embodiments will illustrate the general principles of the invention with reference to a steering-column gearshift lever for use with a motor vehicle. Other embodiments suitable for other applications will be apparent to those skilled in the art given the benefit of this disclosure.

Figure 2:
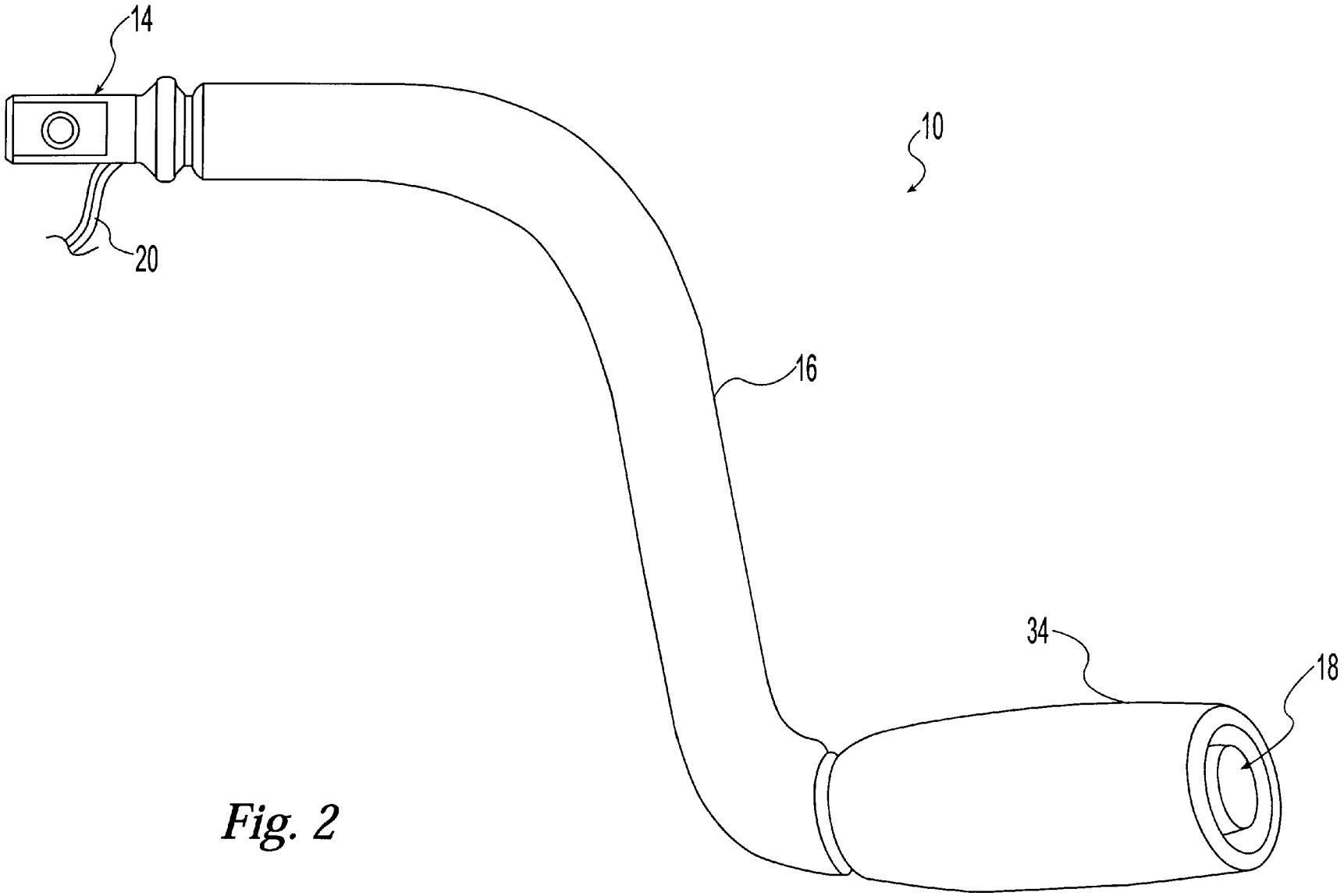
FIG. 2 is a front elevational view of the steering-column gearshift lever of FIG. 1.

Referring now to the drawings, FIGS. 1 and 2 show a steering column gearshift lever 10 for a motor vehicle, such as an automobile, according to a preferred embodiment of the present invention. While the illustrated embodiments of the present invention are particularly adapted for use with an automobile, it is noted that the present invention can be utilized with any motor vehicle having a steering-column mounted lever including trucks, buses, vans, recreational vehicles, earth moving equipment and the like, off road vehicles such as dune buggies and the like, air borne vehicles, and water borne vehicles.

The illustrated steering-column gearshift lever 10 includes a tube 12, an insert or attachment 14 secured to an end of the tube 12 to secure the gearshift lever 10 to a steering column, a covering 16 over at least a portion of the exterior surface of the tube 12 and the insert 14, an electric switch 18 secured to an end of the tube 12 to control a desired device, and wires 20 extending through the tube 12 from the electric control or switch 18 at one end of the tube 12 to the insert 14 at the other end of the tube 12 so that the electric switch 18 can be electrically connected to suitable auxiliary components at the steering column.

Figure 3:
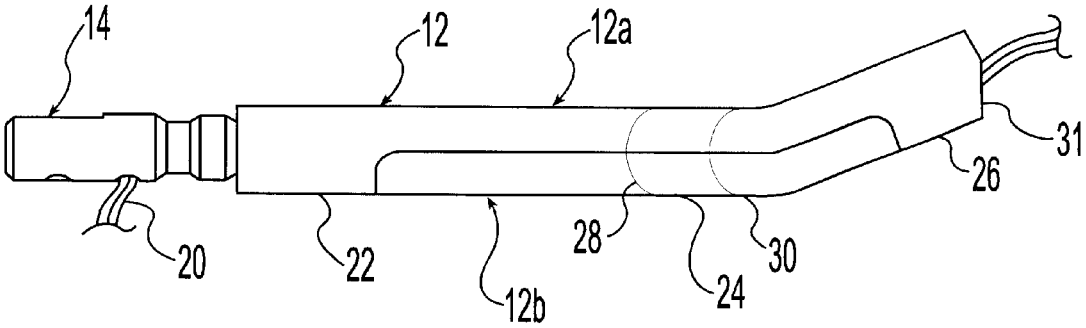
FIG. 3 is a top plan view of the steering-column gearshift lever of FIGS. 1 and 2 but with components removed for clarity to show a tube assembly.
Figure 4:
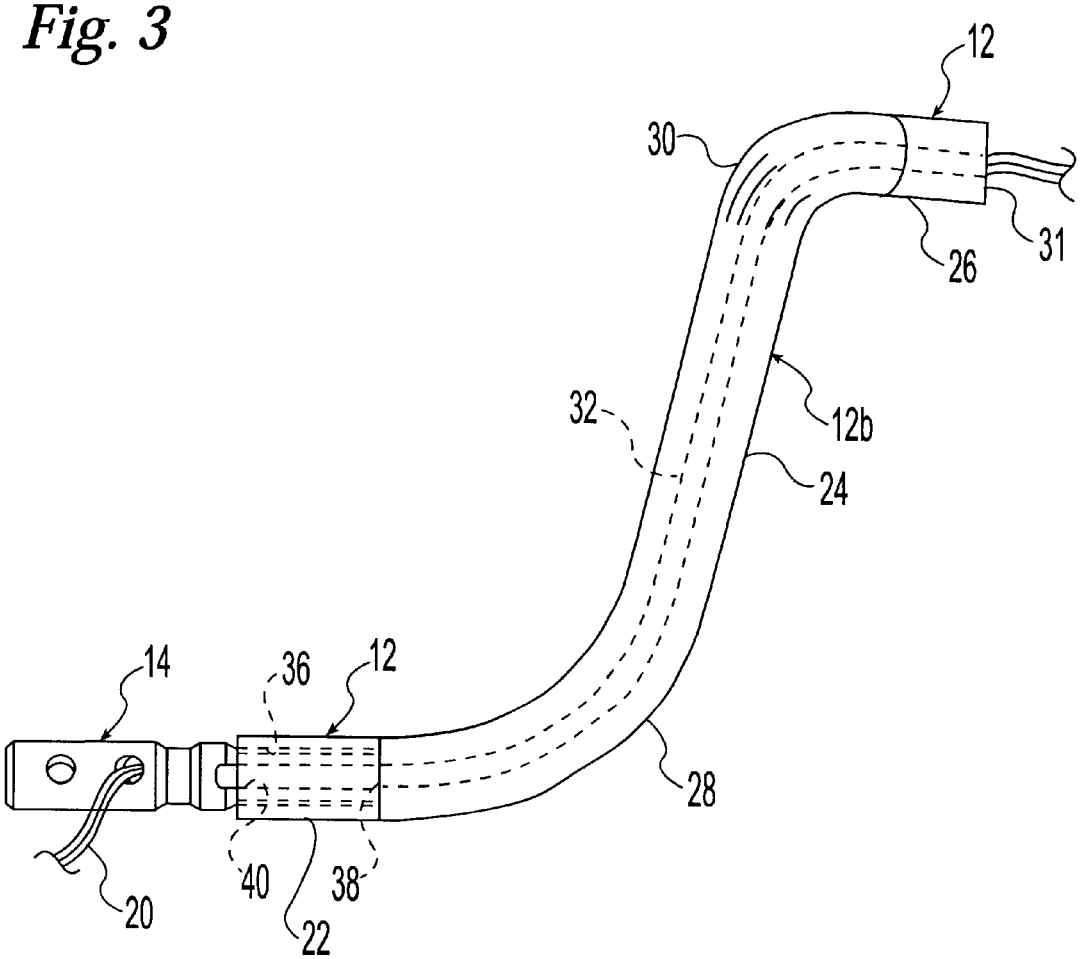
FIG. 4 is a rear elevational view of the tube assembly of FIG. 3.
Figure 5:
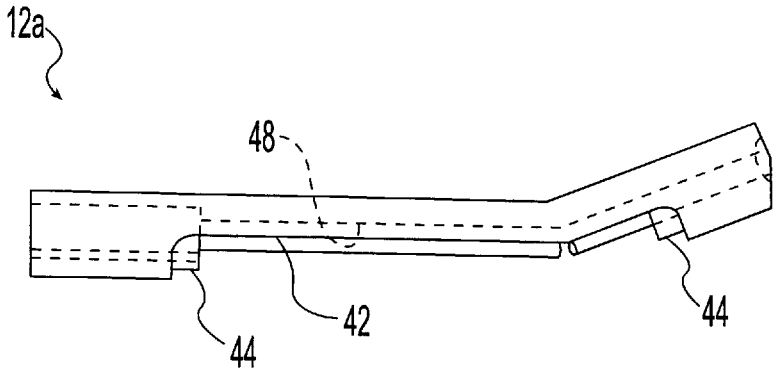
FIG. 5 is a top plan view of a main portion of the tube shown in FIGS. 3 and 4.

As best shown in FIGS. 3 and 4, the tube 12 is a generally elongate member having complex compound bends, that is, having bends which cause the tube to extend in more than one plane. As best viewed in FIG. 4, the tube is generally "S"-shaped having a first or lower portion 22 which is generally straight, a second or central portion 24 which is generally straight, and a third or upper portion 26 which is generally straight. The lower portion 22 is connected to the central portion 24 with a first bend or curve 28 such that the lower and central portions 22, 24 extend generally in the same plane (best shown in FIG. 3). The first bend 28 preferably forms an angle between the lower and central portions 22, 24 in the range of about 88 degrees to about 118 degrees and more preferably in the range of about 100 degrees to about 105 degrees. Formed in this manner, the central portion 24 upwardly and outwardly extends from an inner end of the lower portion 22. The central portion 24 is connected to the upper portion 26 with a second bend or curve 30 such that the upper portion 26 extends generally in a different plane (best shown in FIG. 3). The second bend 30 preferably forms an angle between the central and upper portions 24, 26 in the range of about 83 degrees to about 113 degrees and more preferably in the range of about 95 degrees to about 100 degrees. Formed in this manner, the upper portion 26 forwardly and downwardly extends from the upper end of the central portion 24. It is noted that the specific dimensions of the tube 12 are sized for specific applications of the gearshift lever 10. It is noted that the upper portion 26 of the illustrated tube 12 is provided with a corner break 31 to provide a line of draw out of the mold tool and thus reduce molding costs.

Figure 6:
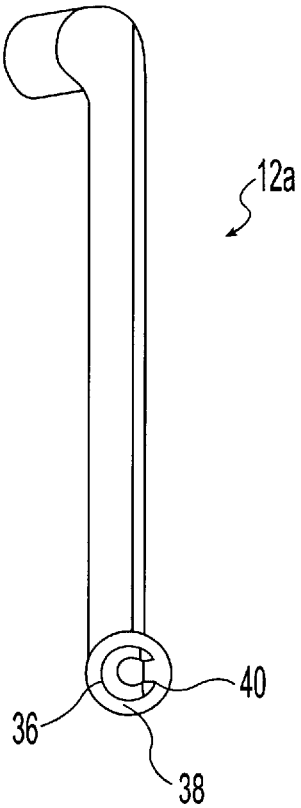
FIG. 6 is a left side elevational view of the tube main portion of FIG. 5.
Figure 7:
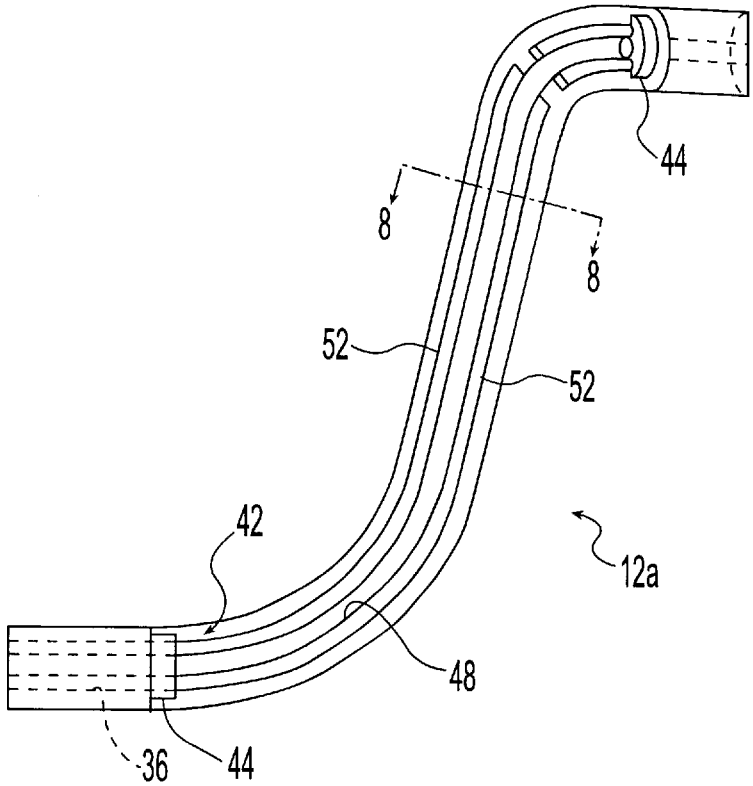
FIG. 7 is a rear elevational view of the tube main portion of FIGS. 5 and 6.
Figure 8:
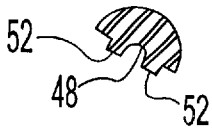
FIG. 8 is a cross-sectional view taken along line 8—8 of FIG. 7.
Figure 9:
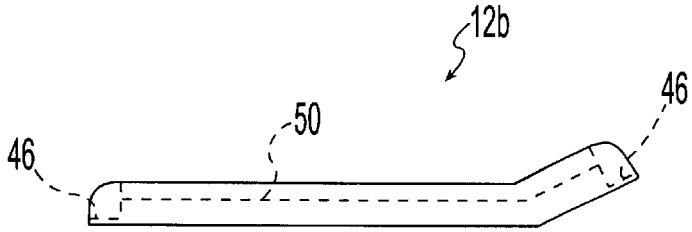
FIG. 9 is a top plan view of a cover portion of the tube shown in FIGS. 3 and 4.
Figure 10:
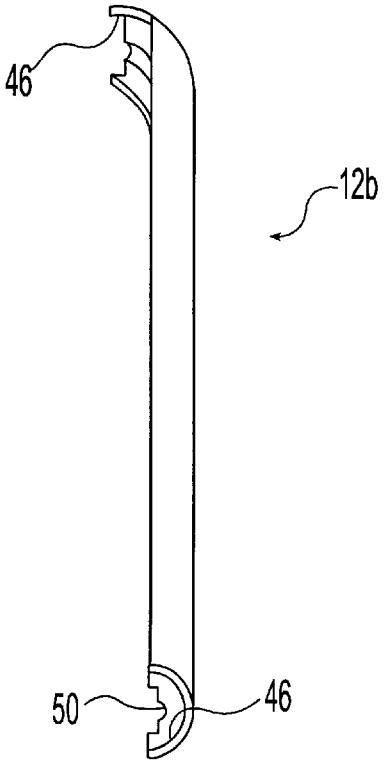
FIG. 10 is a left side elevational view of the tube cover portion of FIG. 9.
Figure 11:
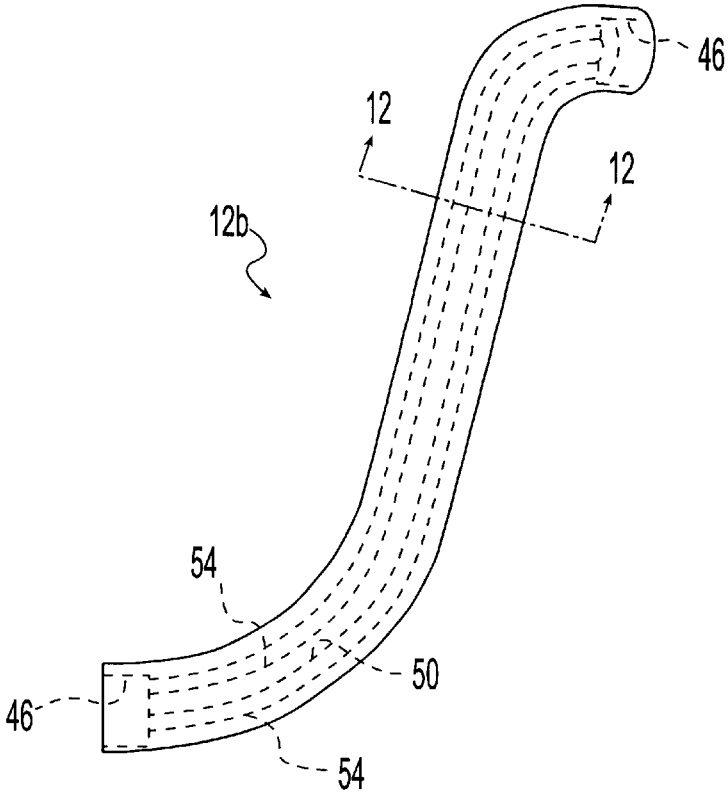
FIG. 11 is a rear elevational view of the tube cover portion of FIGS. 9 and 10.
Figure 12:
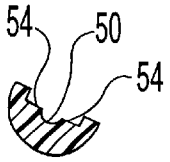
FIG. 12 is a cross-sectional view taken along line 12—12 of FIG. 11.

The tube 12 has a generally circular outer surface in cross-section and forms a central passage or conduit 32 generally extending from a first or operative end to a second or attachment end. The conduit 32 is sized and shaped for passage of the wires 20 therethrough as described in more detail hereinafter. The operative end is sized and shaped for receiving a molded handle or knob member 34 (FIG. 1) cooperating with the electric switch 18. The attachment end is preferably provided with a bore or pocket 36 forming an outward facing abutment 38 for engagement by the insert 14. The pocket 36 is sized and shaped for receiving the insert 14 as described in more detail hereinafter. Preferably formed in the pocket 36 is a longitudinally extending key 40 having a rectangular-shaped cross section (best shown in FIGS. 5–7).

The tube 12 preferably includes a main portion 12*a* and a cover portion 12*b* which cooperate to form the conduit 32. The illustrated cover portion 12*b* generally engages the main portion 12*a* along a central parting line such that the cover portion 12*b* and the main portion 12*a* each form about one half of the cross-section of the tube 12. The illustrated cover portion 12*b* extends a limited distance along the length of the main portion 12*a,* that is, the cover portion 12*b* does not extend the fill length of the main portion 12*a.* The cover portion 12*b* preferably extends from an intermediate point along the lower portion 22 to an intermediate point along the upper portion 26.

As best shown in FIGS. 5–12, the main portion 12*a* generally forms a seat 42 for the cover portion 12*b.* Raised portions or protrusions 44 are provided at the ends of the seat 42 to cooperate with recesses 46 formed in the ends of the cover portion 12*b.* A first channel 48 centrally extends along the seat 42 which cooperates with a second channel 50 which centrally extends along the cover portion 12*b* to form the conduit 32.

Elongate protrusions 52 extend along the sides of the first channel 48 in a parallel manner which cooperate with elongate recesses 54 formed along the sides of the second channel 50 in a parallel manner. The protrusions and the recesses cooperate to generally form a seal, in a "tongue-and-groove" manner, between the exterior of the tube 12 and the conduit 32 such that material does not bleed into the conduit 32 during molding of the covering 16 as described in more detail hereinafter. The protrusions 52 and the recesses 54 interlock the main and cover portions 12*a,* 12*b* to form a tortuous path between the exterior of the tube 12 and the conduit 32. The illustrated protrusions and recesses 52, 54 are contiguous with the first and second channels 48, 50 respectively but alternatively can be spaced apart from the first and second channels 48, 50. The illustrated protrusions 52 are generally rectangular-shaped in cross section but alternatively can be other suitable shapes such as, for example, semi-circular or triangular. It is noted that the locations of the protrusions and recesses 52, 50 can alternatively be reversed, that is, the recesses 54 formed on the main portion 12*a* and the protrusions 52 formed on the cover portion 12*b.* The main and cover portions 12*a,* 12*b* are preferably formed of a rigid polymeric material such as, for example, a glass-reinforced nylon capable of handling the required loads of a steering-column gearshift lever 10. Other suitable materials are, for example, polyester-filled nylon and ceramic. The main and cover portions 12*a,* 12*b* can be separately formed by any suitable process such as, for example, injection molding, gas-assist injection molding, or the like.

Figure 13:
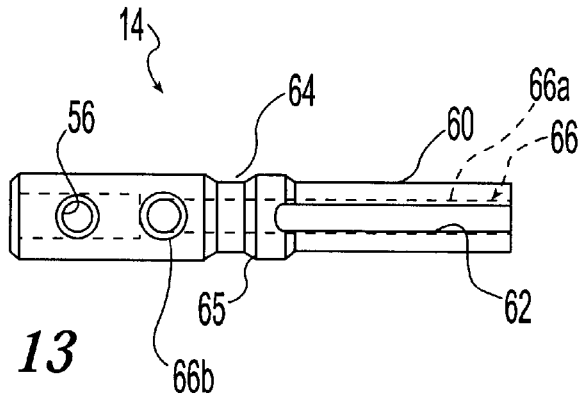
FIG. 13 is a rear elevational view of an insert of the tube assembly of FIGS. 3 and 4.
Figure 14:
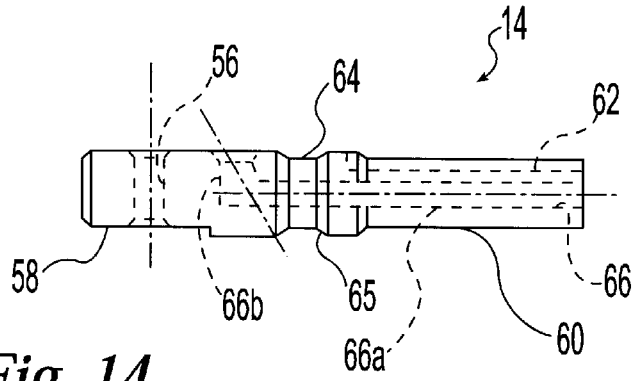
FIG. 14 is a bottom plan view the insert of FIG. 13.

As best shown in FIGS. 13 and 14, the insert 14 has a first end sized and shaped for mechanical cooperation with components auxiliary to the gearshift lever 10 to connect the gearshift lever 10 to the steering column and a second end sized and shaped for cooperation with the pocket 36 formed in the attachment end of the tube 12. The insert 14 is preferably circular in cross section. The illustrated first end is provided with a laterally extending opening 56 therethrough and a flat surface 58 at one end of the opening 56 for use in connection of the gearshift lever 10 to the auxiliary components. The second end has a reduced diameter portion 60 sized and shaped for insertion into the tube pocket 36 and is provided with longitudinally extending keyway 62 for cooperation with the key 40 of the tube 12. The key 40 and the keyway 62 provide a desired orientation of the insert 14 relative to the tube 12 and resistance to relative rotation between insert 14 and the tube 12.

The insert 14 is preferably provided with a circumferentially groove 64 at an intermediate position along the length of the insert 14 such that it is near the attachment end of the tube 12 when the insert 14 is position in the tube 12. The groove 64 is sized and shaped to receive a portion of the coating 16 to provide resistance to relative longitudinal movement between the insert 14 and the tube 12. Particularly, the groove 64 forms a generally outward facing abutment 65 which resists outward movement of the insert 14 from the tube pocket 36 when the coating 16 is received in the groove 64. It is noted that other means for interlocking the insert 14 with the coating 16 to provide resistance to relative longitudinal movement can alternatively be provided such as, for example, grooves, slots, fins and the like.

The insert 14 forms a passage 66 which cooperates with the conduit 32 of the tube 12 such that the wires 20 extend from conduit 32 at the attachment end of the tube 12, through the passage 66, and out of the side of the insert 14. The illustrated passage 66 has a first or longitudinally-extending portion 66*a* and a second or laterally-extending portion 66*b.* The longitudinally-extending portion 66a extends from the second end of the insert 14 to an intermediate point between the groove 64 and the opening 56 along the central axis 68 of the insert 14 to generally form and extension of the conduit 32 of the tube 14 when the insert 14 is positioned in the tube pocket 36. The laterally-extending portion 66*b* extends from the inner end of the longitudinally-extending portion 66*a* to a lateral side of the insert 14. The laterally-extending portion 66*b* preferably is angled toward the first end of the insert 14, that is, is formed at an angle of less than 90 degrees relative to the central axis 68 of the insert 14. The passage 66 is sized for passage of the wires 22 therethrough and is preferably provided with suitable reliefs to remove sharp edges which may damage the wires 20.

The insert 14 is preferably formed of a suitable metal such as, for example, a steel and can be formed by any suitable process such as, for example, machining.

As best shown in FIGS. 1 and 2, the covering 16 extends over at least a portion of the exterior surface of the tube 12 and the insert 14 to secure the tube main portion 12*a* and the tube cover portion 12*b* together and to secure the tube 12 and the insert 14 together. The covering 16 is preferably a polymeric material such as, for example, glass-mineral nylon like CAPRON 8267G HS by AlliedSignal Plastic or other suitable nylon resins. The covering 16 is preferably formed by an injection molding step separate from the injection molding steps of the tube components 12*a,* 12*b*. After the tube main and cover portions 12*a,* 12*b* have been separately formed they are positioned within a mold along with the insert 14. Polymeric material is then injected into the mold to form the covering 16. The interlocking interface between the tube main and cover portions 12*a,* 12*b* prevents bleeding of the polymeric material into the conduit 32. The ends of the conduit 32 are plugged by the insert an a core to prevent bleeding of the material into the conduit 32 through its ends. It is noted that tube portions 12*a,* 12*b* are preferably sized to engage with an interference fit such that the interference fit and the covering 16 secure the tube portions 12*a,* 12*b* together. It is also noted that the tube 12 and insert 14 are preferably sized for an interference fit such that the interference fit and the covering 16 secure the tube 12 and the insert 14 together. With the tube 12 and covering 16 formed in this manner, additional means, such as fasteners, to secure the tube main and cover portions 12*a,* 12*b* together and to secure the tube 12 and the insert 14 together are not required. It is noted that the covering 16 preferably extends into the groove 64 of the insert 14 to provide additional resistance to relative axial movement between the insert 14 and the tube 12.

The operational end of the tube 12 is preferably provided with the a handle member 34. The handle member 34 can be a separate member secured to the tube 12 and/or can be integrally formed with the tube 14 and/or covering. The illustrated handle member 34 is separately formed thereon by a third molding operation wherein the handle member 34 is injection molded over the covering 16. The handle member 32 can be formed of the same material as the covering 16.

The electric switch 18 is also provided at the operational end of the tube 12. The illustrated electric switch 18 is supported by the tube 12 and encircled by the handle member 34. The electric switch 18 can be of any suitable type such as, for example, the illustrated push-button type switch. The wires 20 are suitably connected to the electric switch 18 and extend from an inner end of the electric switch 18 through the conduit 32 of the tube 12 to the attachment end of the tube 12, into and through the passage 66 of the insert 14, and out of the passage 66 at the side of the insert 14 where they are connectable to auxiliary components upon attachment of the gearshift lever 10 to a steering column. The electric switch 18 is preferably connected to the handle member 34 by an interference and/or snap fit connection. Operation of the electric switch 18 permits the operator to control or operate a desired component from the free or operational end of the gearshift lever.

Figure 15:
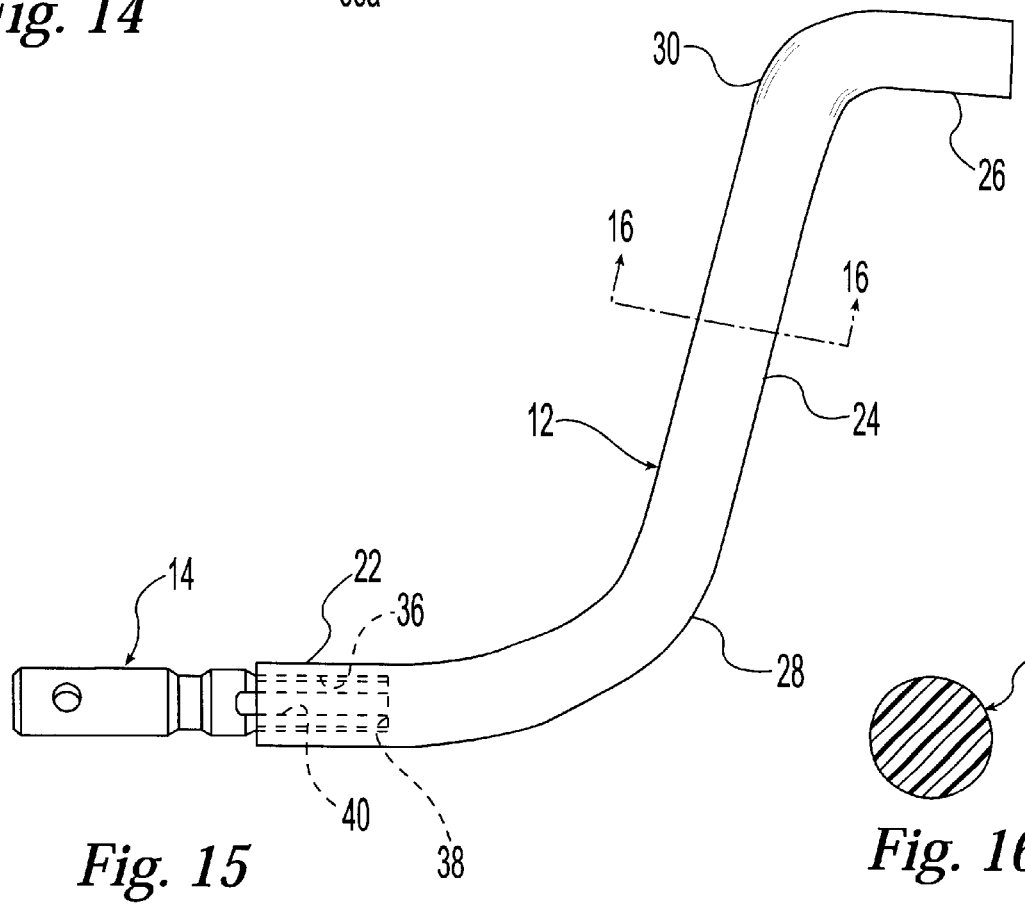
FIG. 15 is a rear elevational view similar to FIG. 4 but showing an alternative embodiment of the tube assembly.
Figure 16:
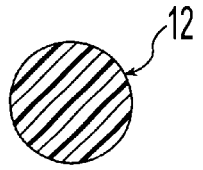
FIG. 16 is a cross-sectional view taken along line 16—16 of FIG. 15.

FIGS. 15 and 16 illustrate a tube assembly according to a second preferred embodiment of the present invention wherein like reference numbers are utilized for like structure. The tube assembly is substantially the same as the tube assembly according to the first embodiment except that it illustrates that the tube 12 can advantageously be a single piece when the switch 18 and the associated wires 20 are eliminated. The tube 12 of the second embodiment is a unitary molded part and is solid, in cross-section, over at least a portion of its length and preferably over a substantial portion of its length. It is noted that when the switch 18 and wires 20 are eliminated, the conduit 32 of the tube 12 and the passage 66 of the insert 14 can also be eliminated. The gearshift lever 10 according to the second embodiment is otherwise substantially the same as the gearshift lever 10 according to the first embodiment except that the handle member 34 is not adapted to cooperate with the switch 18.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the tube can have many different shapes and bends. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A steering-column gearshift lever comprising, in combination:

a tube comprised of a polymeric material and forming a conduit from an operative end to an attachment end;

an electrical switch supported by the operative end of the tube;

wires connected to the electrical switch and passing through the conduit from the operative end to the attachment end;

wherein the tube has compound bends such that a central axis of the tube extends in more than one plane;

wherein the tube includes a main portion extending a full length of the tube from the operative end to the attachment end and a cover portion extending along the compound bends such that the main portion and the cover portion cooperate to form the conduit; and wherein the cover portion extends for only a limited portion of a length of the tube main portion from a first intermediate point along the tube to a second intermediate point along the tube, the first and second intermediate points located between the operative end and the attachment end.

2. The steering-column gearshift lever according to claim 1, wherein the tube is comprised a reinforced nylon resin.

3. The steering-column gearshift lever according to claim 1, further comprising a metal insert secured to the attachment end and sized and shaped for mechanical cooperation with components auxiliary to the lever.

4. The steering-column gearshift lever according to claim 3, wherein the insert forms a passage which cooperates with the conduit and wherein the wires extend through both the conduit and the passage.

5. The steering-column gearshift lever according to claim 1, further comprising a covering over at least a portion of an exterior surface of the tube, the covering comprising a polymeric material.

6. The steering-column gearshift lever according to claim 5, wherein the covering and the tube are separately molded.

7. A steering column gearshift lever comprising, in combination:

a tube comprised of a polymeric material and forming a conduit from an operative end to an attachment end, the tube including a main portion and a cover portion adapted to cooperate with the main portion to form the conduit;

a covering over at least a portion of an exterior surface of the tube, the covering comprising a polymeric material, wherein the tube and the covering are separately molded;

wherein the tube has compound bends such that a central axis of the tube extends in more than one plane;

wherein the main portion extends a fill length of the tube from the operative end to the attachment end and the cover portion extends along the compound bends such that the main portion and the cover portion cooperate to form the conduit; and wherein the tube cover portion extends for only a limited portion of a length of the tube main portion from a first intermediate point along the tube to a second intermediate point along the tube, the first and second intermediate points located between the operative end and the attachment end.

8. The steering-column gearshift lever according to claim 7, wherein the tube main portion and the tube cover portion are secured together by an interference fit therebetween.

9. The steering-column gearshift lever according to claim 7, wherein the tube main portion and the tube cover portion are adapted to generally seal the interface therebetween.

10. The steering-column gearshift lever according to claim 9, wherein the tube main portion and the tube cover interlock in at least one direction.

11. The steering-column gearshift lever according to claim 7, wherein the tube is comprised a reinforced nylon resin.

12. The steering-column gearshift lever according to claim 11, wherein the covering is comprised a nylon resin.

13. The steering-column gearshift lever according to claim 5, wherein the covering entirely covers the cover portion.

14. The steering-column gearshift lever according to claim 7, wherein the covering entirely covers the cover portion.

* * * * *

UNITED STATES PATENT AND TRADEMARK OFFICE

CERTIFICATE OF CORRECTION

PATENT NO. : 6,439,074 B1
DATED : August 27, 2002
INVENTOR(S) : Jacob M. Stencel It is certified that error appears in the above-identified patent and that said Letters Patent is hereby corrected as shown below:

Column 10,
Line 14, delete “fill” and add -- full --

Signed and Sealed this

Twenty-eighth Day of January, 2003

JAMES E. ROGAN
*Director of the United States Patent and Trademark Office*